United States Patent [19]

Asselin

[11] 4,058,454

[45] Nov. 15, 1977

[54] AROMATIC HYDROCARBON SEPARATION VIA SOLVENT EXTRACTION

[75] Inventor: George F. Asselin, Mount Prospect, Ill.

[73] Assignee: UOP Inc., Des Plaines, Ill.

[21] Appl. No.: 679,272

[22] Filed: Apr. 22, 1976

[51] Int. Cl.[2] ..... C10G 21/28

[52] U.S. Cl. ..... 208/321; 260/674 SE

[58] Field of Search ..... 208/321; 260/674 SE

[56] References Cited

U.S. PATENT DOCUMENTS

| | | | |
|---|---|---|---|
| 3,065,169 | 11/1962 | Zuiderweg et al. | 208/321 |
| 3,396,101 | 8/1968 | Broughton | 208/313 |
| 3,466,345 | 9/1969 | DeGraff et al. | 208/321 |
| 3,466,346 | 9/1969 | DeGraff et al. | 260/674 SE |

*Primary Examiner*—Herbert Levine

*Attorney, Agent, or Firm*—James R. Hoatson, Jr.; Robert W. Erickson; William H. Page, II

[57] ABSTRACT

A solvent extraction process for separating polar hydrocarbons from non-polar hydrocarbons. The solvent-rich extract phase from the extraction zone is introduced into a stripping column. The stripper bottoms, being a polar hydrocarbon-containing, first solvent-rich stream, is introduced into an upper portion of a solvent recovery column. A vaporous stripping medium is introduced into a lower portion of the solvent recovery column. A second solvent-rich stream, virtually free from hydrocarbons, is withdrawn as a bottoms product and recycled to the extraction zone, while a hydrocarbon-containing, side-cut third solvent-rich phase is withdrawn, and a portion introduced into the stripping column in admixture with the extract phase. Of the total recovery column solvent-rich streams, the amount commingled with the fresh hydrocarbon feed and introduced therewith into the extraction zone, is from about 5.0% to about 25.0% of the total solvent introduced thereto.

8 Claims, 1 Drawing Figure

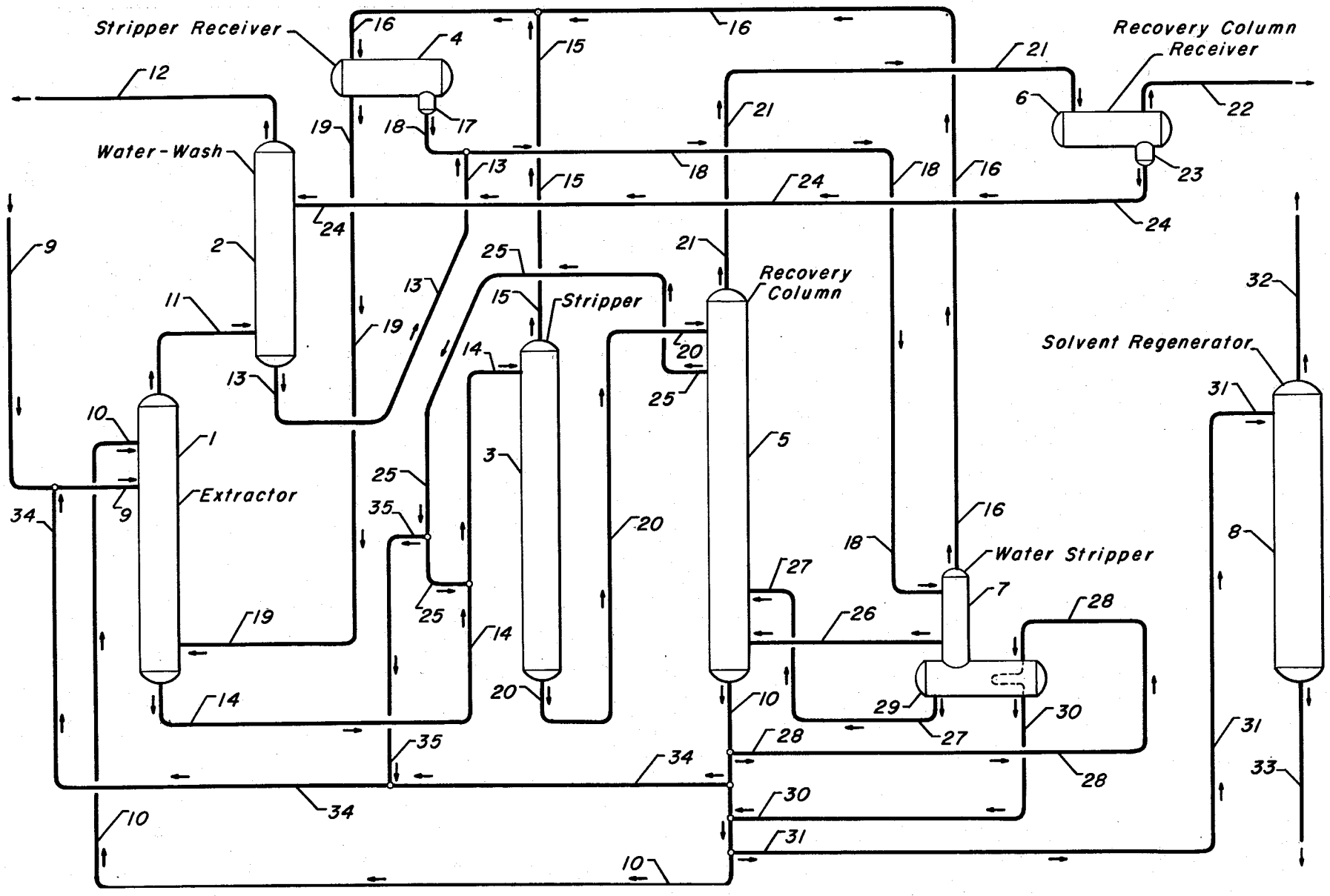
Recovery Column Receiver
Solvent Regenerator
Water Stripper
Recovery Column
Stripper
Stripper Receiver
Water-Wash
Extractor

AROMATIC HYDROCARBON SEPARATION VIA SOLVENT EXTRACTION

APPLICABILITY OF INVENTION

As herein described, the present invention is adaptable for use in the separation and ultimate recovery of polar hydrocarbons from non-polar hydrocarbons, which separation is effected through the use of a solvent characteristically selective for absorbing polar hydrocarbons. More specifically, my invention is directed toward the separation and recovery of aromatic hydrocarbons from various mixtures thereof with non-aromatic hydrocarbons. The use of the terms "polar" and "non-polar" in the present specification and appended claims, is intended to distinguish between classes of hydrocarbons wherein one particular type is more polar than the other. For example, in an extraction process intended to recover naphthenes from a mixture thereof with paraffins, the former are "polar" and the latter "non-polar". When extracting aromatics from a mixture thereof with naphthenes, the naphthenes are considered "non-polar" with respect to the aromatic hydrocarbons which are "polar".

In one of its specific applications, the separation process evolved from the present invention serves to segregate particular species of aromatic hydrocarbons such as benzene, toluene and/or $C_8$-aromatics from other hydrocarbons normally contained in petroleum fractions and distillates. The process utilizes a solvent which may be indefinitely recycled within the system, yields the desired product in high purity and separates the same substantially in its entirety from the feedstocks charged to the process. My invention is particularly applicable as an improvement in the type of separation process wherein a mixture of various classes of hydrocarbons is introduced into an extraction zone and is countercurrently contacted therein with a solvent selective for aromatic hydrocarbon adsorption. A raffinate phase, comprising substantially all of the non-aromatic hydrocarbons in the feedstock, is removed from one end portion of the extraction zone at which the solvent is introduced. An extract phase comprising the aromatic components of the feedstock and the selected solvent is removed from the other end portion of the extraction zone.

Although my invention is applicable for utilization with any hydrocarbon feedstock having a sufficiently high aromatic concentration to justify the recovery thereof — e.g. at least about 25.0% by volume — distinct advantages are afforded when processing those feedstocks having an aromatic concentration exceeding about 75.0% by volume. The feedstock will generally include, in addition to $C_6$, $C_7$ and $C_8$-aromatics, non-aromatics predominating in $C_8$ and $C_9$-paraffins and naphthenes. Exemplary of various sources of suitable charge stocks are the depentanized effluent from a catalytic reforming unit, wash oils, and especially coke oven by-products and hydrotreated pyrolysis naphthas.

Briefly, the present inventive concept involves introducing a mixture of polar hydrocarbons, non-polar hydrocarbons and the characteristically selective solvent into a first fractionation column (stripping column). The bottoms, a solvent-rich polar hydrocarbon-containing stream is introduced into a second fractionating column (solvent recovery column), from which a substantially hydrocarbon-free second solvent-rich stream is withdrawn as a bottoms product. A third solvent-rich stream, containing hydrocarbons, is withdrawn as a side-cut product, principally for introduction into the first fractionation column and preferably in admixture with the extract phase feed stream from the extraction zone. A vaporous stream is introduced into the lower portion of the second fractionation column which permits recovery of a virtually hydrocarbon-free, solvent-rich bottoms stream. In accordance with the present process, at least a portion of one of said second and third solvent-rich streams is introduced into the extraction zone in admixture with the fresh hydrocarbon feed stream. That is, the solvent-rich stream may be derived (1) totally from the second fractionation column bottoms, (2) from the side-cut stream or, (3) from a portion of each. Generally, the quantity commingled with the charge to the extraction zone will be about 5.0% to about 25.0% of the total solvent-rich streams introduced into the extraction zone. The remaining portion of the bottoms solvent-rich stream is introduced into the upper section of the extraction zone through a locus above that through which the polar/non-polar hydrocarbon mixture is introduced.

PRIOR ART

It must be recognized that the prior art proliferates in a wide spectrum of solvent extraction techniques for effecting the separation of aromatic hydrocarbons from a mixture thereof with non-aromatic hydrocarbons. No attempt will be made herein to delineate exhaustively the appropriate published literature; it will suffice simply to note several examples which appear exemplary of various prior art practices and procedures, and to which the present invention is most suitably applicable. The overwhelming majority of solvent extraction processes indicate a distinct preference for a water-soluble solvent comprising an oxygenated organic compound. A review of the relevant prior art indicates that the prevalent solvent is either a sulfolane-type organic compound, or an alkylene glycol, preferably a polyalkylene glycol. While most prior art processes are intended for utilization with either of these water-soluble solvents, specific techniques have been illustrated which are peculiar either to one, or the other.

The use of a light paraffin backwash stream in the solvent extraction column, to displace heavier non-aromatic components in the extract phase, is shown in U.S. Pat. No. 3,037,062 (Cl. 260–674), issued May 29, 1962. The aromatic concentrate is recovered as a side-cut from the stripping column and subsequently introduced into fractionation facilities for separation into the individual aromatic components. The rectification of a solvent-rich side-cut from the stripping zone is disclosed in U.S. Pat. No. 3,173,966 (Cl. 260–674), issued Mar. 16, 1965. This technique affords the recovery of substantially solvent-free water for subsequent utilization within the process.

U.S. Pat. No. 3,396,101 (Cl. 208–313), issued Aug. 6, 1968, involves introducing a mixture of charge stock and lean solvent into the stripping column from which a non-aromatic overhead stream is withdrawn and introduced into the extraction zone. The resulting rich solvent is passed from the reaction zone to the stripping column as a second feed stream thereto. The bottoms from the stripping column is introduced into a solvent recovery zone, the recovered solvent being withdrawn as a single bottoms stream for recycle in part to the extraction zone and in part to the stripping column.

In U.S. Pat. No. 3,436,435 (Cl. 260–674), issued Apr. 1, 1969, an aromatic side-cut is withdrawn from the stripping column, introduced into an entrainment separator from which an aromatic concentrate is subsequently transported to fractionation facilities. A solvent-containing bottoms stream is withdrawn from the entrainment separator and reintroduced into an intermediate locus of the stripping column.

Still another variation is that found in U.S. Pat. No. 3,723,256 (Cl. 203–43), issued Mar. 27, 1973. Initially, the aromatic hydrocarbon feed is introduced into a distillation column from which a light fraction and a heavier bottoms fraction are recovered. The former is passed into an extractive distillation tower while the latter is introduced into a liquid extraction unit. The extract from the liquid extraction unit is stripped of non-aromatic hydrocarbons to produce a non-aromatics free fraction and a non-aromatics containing fraction. The aromatics recovered in admixture with the solvent, from the extractive distillation column, are passed to a recovery section in admixture with the aromatic-containing fraction from the stripping zone. The overhead stream from the extractive distillation column and the non-aromatics from the stripping zone are passed in admixture to the bottom section of the solvent extraction zone, to function therein as a reflux stream.

U.S. Pat. No. 3,466,346 (Cl. 260–674), issued Sept. 9, 1969, is specifically directed toward the separation of the extract phase from the solvent extraction zone. The technique involves withdrawing, from both the extractive distillation column and the aromatic recovery distillation column, a side-cut fraction. With respect to the extractive distillation column, the side-cut fraction is introduced as a vapor directly into the aromatic recovery column. The side-cut fraction from the aromatic recovery column, being a lean solvent stream containing aromatic hydrocarbons, is returned to the extractive distillation column in admixture with the extract phase introduced thereto. It should be noted that there is no awareness respecting the introduction of a vaporous stripping medium into the lower portion of the recovery column in accordance with the method of the present invention.

The utilization of the present inventive concept significantly decreases the quantity of hydrocarbons remaining in the lean solvent stream withdrawn from the bottom of the solvent recovery column. Since this lean solvent stream is recycled to the solvent extraction zone, for re-use therein, the efficiency of separation effected therein is further enhanced. Introducing a portion of the lean solvent in admixture with the fresh feed eliminates column loading at the top of the extraction zone which otherwise results from high aromatic feed streams — e.g. more than about 75.0% by volume.

OBJECTS AND EMBODIMENTS

A principal object of my invention is to enhance and facilitate the recovery of polar hydrocarbons from a mixture thereof with non-polar hydrocarbons. A corollary objective resides in a method for separating the polar hydrocarbons from a mixture thereof with non-polar hydrocarbons and a solvent characteristically selective for absorbing the polar hydrocarbons.

A specific object of my invention is to effect a reduction in the cost of utilities (energy savings) while separating aromatic hydrocarbons from a mixture thereof with non-aromatic hydrocarbons and the selective solvent, while simultaneously enhancing the efficiency with which aromatic hydrocarbons are originally extracted from a mixture thereof with non-aromatic hydrocarbons.

Therefore, one embodiment of the present invention is directed toward a process for the recovery of polar hydrocarbons from a mixture thereof with non-polar hydrocarbons, which process comprises the steps of: (a) introducing said polar/non-polar mixture into an extraction zone, and therein contacting said mixture with a solvent characteristically selective for absorbing polar hydrocarbons, at conditions selected to maintain said mixture and solvent in liquid phase; (b) removing a non-polar hydrocarbon raffinate stream from said zone, through an upper locus thereof; (c) removing a polar hydrocarbon, solvent-rich extract stream from said zone, through a lower locus thereof, and introducing said extract stream into a stripper column; (d) removing a non-polar hydrocarbon concentrate from said stripper column, through an upper locus thereof, and removing a polar hydrocarbon-containing first solvent-rich stream from said stripper column, through a lower locus thereof; (e) introducing said first solvent-rich stream into a solvent recovery column, through a first locus thereof, introducing a vaporous stripping medium into a lower, second locus thereof, recovering a substantially solvent-free polar hydrocarbon concentrate through an upper third locus thereof, removing a substantially hydrocarbon-free, second solvent-rich stream from a lower fourth locus thereof and removing a third solvent-rich stream, containing hydrocarbons, through an intermediate fifth locus thereof; (f) introducing at least a portion of said third solvent-rich stream into said stripper column; and, (g) commingling at least a portion of one of said second and third solvent-rich streams with said polar/non-polar mixture for introduction therewith into said extraction zone.

Other objects and embodiments of my invention will become evident from the following more detailed description thereof. In one such other embodiment, the volumetric ratio of the second solvent-rich stream to the third solvent-rich stream, both of which are removed from the recovery column, is in the range of about 1.5:1.0 to about 4.0:1.0.

SUMMARY OF INVENTION

As hereinbefore set forth, the technique encompassed by my inventive concept is intended for integration into a solvent extraction process for the separation and recovery of polar hydrocarbons from a mixture thereof with non-polar hydrocarbons. Although thus applicable to a multitude of hydrocarbon mixtures, the following discussion will be directed primarily to the separation and recovery of aromatic hydrocarbons from a mixture thereof with paraffins and/or naphthenes. Initially, the mixture of hydrocarbons is contacted with a water-soluble, oxygen-containing solvent characteristically selective for the extraction of polar hydrocarbons. As hereinbefore stated, and as hereinafter illustrated, a portion of the lean solvent, obtained from the solvent recovery column is admixed with the hydrocarbonaceous charge stock and introduced therewith into the solvent extraction zone. The major proportion of lean solvent is introduced into the extraction zone through a locus above that through which the feedstock is introduced. Preferably, from about 5.0% to about 25.0% (by volume) of the total recovery column lean solvent is commingled with the fresh feed stream. This technique prevents column loading in the upper regions of the extraction zone characteristically present when separating highly aromatic mixtures — e.g. at least about 75.0% by volume aromatics. There is recovered, from the solvent extraction zone, an extract stream containing aromatic hydrocarbons and a major proportion of the water-soluble solvent, and a raffinate stream containing non-aromatic hydrocarbons and a relatively minor proportion of the water-soluble solvent. The raffinate stream is generally contacted, in countercurrent flow, with water to recover the solvent and to provide a hydrocarbon concentrate which is substantially free from solvent.

The solvent-rich extract phase, removed from a lower portion of the solvent extraction column, is introduced into the upper portion of a stripping column, the principal function of which is to remove substantially all the non-aromatic hydrocarbons in an overhead stream. Two types of columns currently in use are suitable for utilization herein: the first type is characterized by the introduction of a vaporous stripping medium directly into the lower portion of the stripping column for the purpose of countercurrently contacting the extract phase; in the second type, the stripping column is the common reboiler type wherein the required heat-input is supplied either by the external reboiling and reintroduction of bottoms material, or through the utilization of a stab-in reboiler heater. It is understood that the precise design of the fractionating column which serves to strip the non-aromatics from the extract phase forms no essential part of the present invention. The overhead stream withdrawn from the stripping column is a hydrocarbon concentrate containing some solvent and water. This stream is introduced into a so-called overhead stripper receiver for separation into a hydrocarbon phase and a solvent/water phase. The hydrocarbon phase, substantially free from solvent and water is introduced into the lower portion of the extraction zone as reflux to recover the aromatics therein. The solvent-/water phase is conveniently combined with the substantially hydrocarbon-free solvent/water phase from the raffinate water-wash column, the mixture being introduced into the central upper portion of a water stripping column.

The solvent-rich, aromatic concentrate, substantially free from non-aromatic hydrocarbons, withdrawn from the lower portion of the stripping column, is introduced into the upper portion of a solvent recovery column, as a first solvent-rich stream. An aromatic concentrate, containing water and being substantially free from solvent, is withdrawn as an overhead stream from the recovery column and introduced into an overhead receiver. The overhead receiver serves to effect a phase separation between the aromatic hydrocarbons, which are recovered, and the water phase which is introduced into the upper portion of the water-wash column for re-use in countercurrently contacting the raffinate phase therein. A second solvent-rich stream, substantially free from hydrocarbons, is withdrawn from the bottom of the solvent recovery column. The greater proportion thereof is introduced into the top of the solvent extraction zone to countercurrently contact the mixed hydrocarbon feed stream. A portion of the solvent recovery bottoms material is diverted and introduced into a solvent regenerator, the regenerated solvent generally being combined with the lean solvent stream from the bottom of the solvent recovery column. In accordance with the present separation method, a third solvent-rich stream, containing hydrocarbons, is withdrawn from an intermediate portion of the solvent recovery column, either all, or the greater portion being introduced into the upper section of the stripping column, preferably in admixture with the feed thereto. As hereinafter indicated, this technique affords advantages respecting operational costs attributed to utilities. However, to ensure that this particular technique does not cause hydrocarbons to be withdrawn with the solvent-rich recovery column bottom stream, a stripping medium is introduced into the lower portion of the solvent recovery column. Further, in accordance with the present invention, the vaporous stripping medium is withdrawn from the lower portion of the water stripping column into which the water phase from the stripper overhead receiver and that from the water-wash column are introduced. The overhead stream from the water stripping column is introduced into the stripper overhead receiver in admixture with the overhead stream from the stripping column. In a preferred embodiment, the water stripping column is maintained at conditions of temperature and pressure which produces the vaporous stripping medium for introduction into the lower portion of the solvent recovery column, as well as a bottoms liquid portion which is preferably introduced into the recovery column through a locus intermediate that from which the solvent-rich side-cut is withdrawn and the stripping medium is introduced.

At least a portion of one of the second and third solvent-rich streams, withdrawn from the solvent recovery column, is diverted and combined with the polar/non-polar hydrocarbon feed stream to the extraction zone. Preferably, the quantity diverted is from about 5.0% to about 25.0% by volume of the total solvent-rich material introduced into the extraction zone. Although the diverted stream may be obtained in total from the recovery column bottoms, or in part from the side-cut stream and the bottoms stream, the particularly preferred technique involves obtaining all of this stream from the side-cut withdrawal.

The withdrawal of the hydrocarbon-containing, solvent-rich side-cut from the recovery column, reduces the load on the reboiler thereof. The introduction of the side-cut into the upper portion of the stripping column affords better separation between aromatic and non-aromatic hydrocarbons. Furthermore, a significantly lesser quantity of steam is required for introduction into the bottom of the solvent recovery column. Therefore, with respect to utilities, energy consumption, expressed as BTU/hr., is significantly reduced. In comparison to a system which functions absent the recovery column side-cut, there is an energy savings of up to about $1.6 \times 10^6$ BTU/hr. ($0.38 \times 10^6$ kg-calories/hr.). The solvent-rich bottoms stream recycled to the extraction column is virtually completely free from hydrocarbons.

SOLVENTS AND OPERATING CONDITIONS

Generally accepted solvents, having solubility selectivity for aromatic hydrocarbons, are water-soluble, oxygen-containing organic compounds. In order to be effective in a system of solvent extraction, such as the process provided by the present invention, the solvent component must have a boiling point substantially greater than that of water, added to the solvent composition for enhancing its selectivity, and, in general, must also have a boiling point substantially greater than the end boiling point of the hydrocarbon feedstock. The solvent composition generally has a density greater than that of the hydrocarbon feedstock and is, accordingly, introduced into the uppermost portion of the solvent extraction zone, thereafter flowing downwardly, countercurrent to the rising hydrocarbon feedstock.

Organic compounds suitable as the solvent component may be selected from the relatively large group of compounds characterized generally as oxygen-containing compounds, particularly the aliphatic and cyclic alcohols, the glycols and glycol ethers, as well as glycol esters. The mono- and polyalkylene glycols in which the alkylene group contains from about 2 to about 4 carbon atoms, such as ethylene glycol, diethylene glycol, triethylene glycol and tetraethylene glycol, propylene glycol, dipropylene glycol, and tripropylene glycol constitute a particularly preferred class of organic solvents useful in admixture with water.

Another particularly suitable class of selected solvents are those commonly referred to as the sulfolanetype. That is, a solvent having a five-membered ring, one atom of which is sulfur, the other four being carbon and having two oxygen atoms bonded to the sulfur atom. The four carbon atoms may be linked with hydrogen or alkyl groups. Other solvents preferably included are the sulfolenes such as 2-sulfolene or 3-sulfolene.

Preferably, the solvent contains a small amount of water dissolved therein to increase the selectivity of the solvent phase for aromatic hydrocarbons over non-aromatic hydrocarbons without substantially reducing the solubility of the solvent phase for the aromatic hydrocarbons. The presence of water in the solvent composition provides a relatively volatile material which is distilled from the fat solvent in the stripping column to vaporize the last traces of non-aromatic hydrocarbons by way of steam distillation. The solvent composition contains from about 0.3% to about 25.0% by weight of water, and generally from about 1.0% to about 15.0% depending upon the particular solvent employed and the process conditions under which the various major vessels are operated. By including water in the solvent composition, the solubility of aromatic hydrocarbons in the solvent, although somewhat reduced in comparison with a non-aqueous solvent, greatly decreases the solubility of raffinate components in the solvent and also reduces the solubility of solvent in the raffinate stream. Although the quantity of solvent in the raffinate at any given instance is relatively small, the cumulative effect of small amounts of solvent in a stream removed from the process flow and thus otherwise lost, reduces the efficiency and economy of the solvent extraction process. The recovery of solvent from the raffinate stream can be accomplished efficiently by countercurrently washing the same with water in a separate washing zone from which an aqueous wash effluent is recovered containing the solvent.

The solvent extraction zone is maintained at conditions of temperature and pressure selected to maintain the solvent and hydrocarbons in liquid phase. Suitable temperatures, with a sulfolane solvent, are within the range of from about 80° F. (26.7° C.) to about 400° F. (204° C.), and preferably at an intermediate level in the range of about 150° F. (65° C.) to about 300° F. (149° C.). The extraction zone will generally function at a pressure from about atmospheric to about 400 psig. (28.22 atm.), and preferably from about 50 psig. (4.40 atm.) to about 150 psig. (11.21 atm.).

The stripping column is generally maintained at moderate pressures and sufficiently high temperatures to produce an overhead stream containing all the non-aromatic hydrocarbons. Typical pressures are in the range of about atmospheric to about 50 psig. (4.40 atm.) although the pressure at the top of the stripper is generally maintained at a level of about 5.0 psig. (1.34 atm.) to about 20.0 psig. (2.36 atm.). Suitable operating temperatures are within the range of about 225° F. (107° C.) to 400° F. (204° C.). Solvent recovery is effected at temperatures ranging from about 130° F. (54° C.) to about 375° F. (191° C.). The recovery column will function at a pressure less than 1.0 atmospheres, and generally at a level of about 80 mm. Hg., absolute (0.11 atm.) to about 700 mm. Hg., absolute (0.92 atm.).

The water-wash column, utilized to remove solvent from the non-aromatic raffinate, will function at a relatively low pressure of about 30 psig. (3.04 atm.) to about 75 psig. (6.10 atm.). Moderate temperatures are also employed, and will range from about 70° F. (21.1° C.) to about 130° F. (54° C.). The water-stripping column is maintained at temperatures in the range of about 200° F. (93° C.) to about 300° F. (149° C.), and pressures from about atmospheric to about 20 psig. (2.36 atm.).

Other operating conditions will be given in conjunction with the description of the present invention as illustrated in the accompanying drawing. Miscellaneous appurtenances, not believed required by those possessing the requisite expertise in the appropriate art, have been eliminated from the drawing. The use of details such as pumps, compressors, controls and instrumentation, heat-recovery circuits, valving, condensers and coolers, start-up lines and similar hardware, etc., is well within the purview of those skilled in the art. It is understood that the illustration as presented is not intended to limit my invention beyond the scope and spirit of the appended claims. In converting to the metric system units, the numerical values have been rounded off to the second decimal place.

DESCRIPTION OF DRAWING

With specific reference now to the drawing, which presents the illustration as a simplified diagrammatic flow scheme, it will be noted that only the major vessels are shown. These are: solvent extraction zone 1; raffinate water-wash column 2; stripping column 3 and the stripper overhead receiver 4; the solvent recovery column 5 and the recovery column overhead receiver 6; water-stripping column 7; and, solvent regenerator 8. Further description of the accompanying drawing will be made in conjunction with a commercially-scaled unit designed to process approximately 5,720 Bbl/day (37.89 $M^3$/hr.) of an aromatic-rich blend of pyrolysis naphtha and coke oven light oil. The feedstock has a molecular weight of about 83.5, and contains about 88.1% by volume aromatics, 6.1% paraffins and 5.8% naphthenes.

The aromatic-rich charge stock, in an amount of about 844.56 lb-moles/hr. (383.89 kg-moles/hr.), or 5,621.20 Bbl/day (37.23 $M^3$/hr.), is introduced into extraction zone 1, via line 9, through an intermediate locus. Lean solvent, virtually completely free from hydrocarbons, in the amount of 405.05 lb-moles/hr. (184.11 kg-moles/hr.) the source of which is hereinafter described, is commingled with the feedstock via line 34. In an operating commercial system, a plurality of feed loci is provided to afford flexibility in adjusting for changes in feed rate and aromatic/non-aromatic feed ratios. For example, in an extraction zone having 95 decks, or trays, the feed loci may be located at trays 42, 54 and 66, with the major portion of the solvent introduced above tray 1 at the top of the zone. Solvent, in this case an aqueous solution of sulfolane, is introduced through an upper locus, in the amount of about 2,970.37 lb-moles/hr. (1350.17 kg-moles/hr.), via line 10. The overall solvent/hydrocarbon volumetric ratio approximates 3.8:1.0, and 88.0% of the total solvent enters the extraction zone via line 10. Extractor 1 is maintained at a top temperature of about 210° F. (99° C.), a top pressure of about 75 psig. (6.10 atm.), a bottom temperature of 183° F. (85° C.) and a bottom pressure of about 115 psig. (8.83 atm.). A bottoms reflux stream, from line 19, the source of which is hereinafter set forth, is introduced at a temperature of about 115° F. (46° C.), in the amount of about 721.72 lb-moles/hr. (328.05 kg-moles/hr.).

A non-aromatic raffinate stream, in the amount of about 86.67 lb-moles/hr. (39.40 kg-moles/hr.), is withdrawn as an overhead stream from extractor 1 and introduced after cooling, via line 11, into water-wash column 2 at a temperature of about 100° F. (37.8° C.) and a pressure of about 60 psig. (5.08 atm.). A solvent-rich aromatic concentrate, in the amount of about 4,855.03 lb-moles/hr. (2,206.83 kg-moles/hr.) is withdrawn from extraction zone 1 by way of line 14. In many solvent extraction processes, a portion of the raffinate, withdrawn via line 11, is recycled, without intermediate heating or cooling, to combine with the charge stream in line 9. Since this modification is not necessary to the present invention, it has not been illustrated in the drawing. The raffinate introduced by way of line 11 is countercurrently contacted by a water stream introduced via line 24, in the amount of about 343.61 lb-moles/hr. (156.19 kg-moles/hr.). Net non-aromatic raffinate, substantially free from solvent, in the amount of 85.49 lb-moles/hr. (38.86 kg-moles/hr.), and containing a minor amount of aromatic hydrocarbons, is recovered via line 12 and transported thereby to suitable storage facilities. Water, in the amount of about 344.79 lb-moles/hr. (156.72 kg-moles/hr.), containing about 1.18 lb-moles (0.54 kg-moles) of sulfolane, is recovered through line 13.

The 4,855.03 lb-moles/hr. (2,206.83 kg-moles/hr.) of solvent-rich material (about 69.5% by volume sulfolane and water) in line 14, is introduced thereby into an upper intermediate locus of stripping column 3. In this illustration, stripper 3 is of the external reboiler type (not illustrated) as contrasted to that wherein a vaporous stripping medium is introduced directly into the reboiler section of the column. It functions at a top temperature of about 245° F. (118° C.) and a top pressure of about 13.0 psig. (1.88 atm.), and a bottom temperature of 335° F. (168° C.) and a bottom pressure of 18.0 psig. (2.22 atm.). Also introduced into stripping column 3, preferably in admixture with the feed stream in line 14, is a solvent-rich stream in line 25, 1,591.74 lb-moles/hr. (723.52 kg-moles/hr.), which has been withdrawn as a side-cut from solvent recovery column 5. The stream in line 25, entering stripping column 3, comprises about 61.27 lb-moles/hr. (27.85 kg-moles/hr.) of water, 1,522.56 lb-moles/hr. (692.07 kg-moles/hr.) of sulfolane and about 7.91 lb-moles/hr. (3.60 kg-moles/hr.) of hydrocarbons. Stripper overhead vapor, in an amount of about 791.18 lb-moles/hr. (359.63 kg-moles/hr.), of which about 9.5% by volume is sulfolane and water, is withdrawn through line 15, condensed, and introduced by way of line 16 into stripper overhead receiver 4. Stripper bottoms, substantially free from non-aromatic hydrocarbons, are removed from stripper 3 through line 20 and introduced thereby into solvent recovery column 5 in the amount of about 5,655.59 lb-moles/hr. (2,570.72 kg-moles/hr.).

Solvent recovery column 5 is maintained at conditions of temperature and pressure sufficient to provide a substantially solvent-free aromatic overhead product in line 21. In this illustration, recovery column 5 has a top temperature of about 145° F. (63° C.), a top pressure of about 283 mm. of Hg., absolute (0.37 atm.), a bottom temperature of about 337° F. (169° C.) and a bottoms pressure of about 450 mm. of Hg., absolute (0.59 atm.). The aromatic concentrate and water in line 21 is recovered in an amount of about 1,102.68 lb-moles/hr. (501.22 kg-moles/hr.). The vaporous overhead material is condensed and introduced into recovery column receiver 6. The aromatic concentrate, in the amount of 759.07 lb-moles/hr. (345.03 kg-moles/hr.) is recovered by way of line 22 and transported thereby to suitable fractionation facilities for the recovery of individual component. Water is withdrawn through dip-leg 23, in the amount of about 343.61 lb-moles/hr. (156.19 kg-moles/hr.), and introduced, via line 24 into raffinate water-wash column 2.

Referring now to stripper overhead receiver 4, the feed thereto constitutes 55.42 lb-moles/hr. (25.19 kg-moles/hr.) of water, withdrawn as an overhead vapor in line 16 from water stripper 7, and the 791.18 lb-moles/hr. (359.63 kg-moles/hr.) of stripping column 3 overhead vapors in line 15. Receiver 4 effects a phase separation whereby the hydrocarbon portion is removed via line 19 to be introduced into extractor 1 as a bottoms reflux, and to effect recovery of aromatic hydrocarbons. A concentrated water stream, containing about 1.2% by volume of sulfolane, is withdrawn from dip-leg 17 through line 18, in the amount of 124.88 lb-moles/hr. (56.76 kg-moles/hr.). The water from raffinate water-wash column 2, in the amount of 344.79 lb-moles/hr. (156.72 kg-moles/hr.), is admixed therewith, via line 13, and the mixture, 469.67 lb-moles/hr. (213.48 kg-moles/hr.), continues through line 18 into an upper portion of water-stripping column 7.

Water stripper 7 functions at a top temperature of about 230° F. (110° C.), a top pressure of about 6.0 psig. (1.41 atm.), a bottom temperature of about 250° F. and a bottom pressure of about 7.0 psig. (1.48 atm.). Overhead vapors, in an amount of 55.42 lb-moles/hr. (25.19 kg-moles/hr.) are withdrawn through line 16, condensed and introduced into stripper receiver 4, in admixture with stripping column 3 overhead vapors. Heat-input to water stripper 7 is supplied by way of indirect heat-exchange with at least a portion, if not all of the lean solvent from line 10, introduced via conduit 28 into reboiler section 29 and exiting therefrom through conduit 30. Stripping vapors, in an amount of 408.51 lb-moles/hr. (185.69 kg-moles/hr.) are withdrawn through line 26, and introduced thereby into recovery column 5 through a lower intermediate locus thereof. The principal purpose of this technique is to maintain the lean solvent concentrate in line 10, in the amount of 3,375.42 lb-moles/hr. (1,534.28 kg-moles/hr.) virtually completely free from aromatic hydrocarbons which otherwise would be introduced into extraction zone 1 with the solvent. As little as 0.5% by volume of aromatics in this stream will have an adverse effect upon the efficiency of separation above the feed locus to extractor 1. Also introduced into an intermediate locus of recovery column 5 is a liquid phase from reboiler section 29, via line 27, in the amount of about 5.74 lb-moles/hr. (2.61 kg-moles/hr.).

The needs of extraction zone 1 and stripping column 3 determine the amount of lean solvent withdrawn from recovery column 5 via lines 10 and 25. With respect to the unit being illustrated, the total quantity is 4,967.16 lb-moles/hr. (2,257.80 kg-moles/hr.), of which 1,591.74 lb-moles (723.52 kg-moles) is introduced via lines 25 and 14 into stripping column 3, 2,970.37 lb-moles (1,350.17 kg-moles) is introduced into the upper section of extraction zone 1, via line 10, and 405.05 lb-moles (184.11 kg-moles) are admixed, via line 34, with the fresh hydrocarbon feed in line 9. The solvent-rich stream entering the stripping column contains 7.91 lb-moles/hr. (3.60 kg-moles/hr.) of aromatic hydrocarbons. The lean solvent introduced into the extraction zone, in admixture with the hydrocarbon feed approximates 12.0% by volume of the total solvent requirement of the extraction zone. In the illustration presented in the drawing, 1,996.79 lb-moles/hr. (907.63 kg-moles/hr.) are withdrawn as the side-cut stream in line 25 and 405.05 lb-moles (184.11 kg-moles) are diverted through lines 35 and 34 for introduction into extraction zone 1 with the hydrocarbon feed in line 9; the remaining 1,591.74 lb-moles/hr. (723.52 kg-moles/hr.) continue through line 25 into the upper section of stripping column 3 in admixture with the extract phase in line 14.

Hydrocarbon-free solvent is recovered from recovery column 5, in the amount of about 2,970.37 lb-moles/hr. (1,350.17 kg-moles/hr.). Of this amount, about 32.17 lb-moles/hr. (14.62 kg-moles/hr.) is diverted through line 31 into the upper section of solvent regenerator 8 which functions at a top temperature of about 350° F. (177° C.) and a top pressure of about 520 mm. of Hg., absolute (0.68 atm.). Deteriorated solvent, in the amount of about 1.27 lb-moles/hr. (0.58 kg-moles/hr.) is removed from the process via line 33. Regenerated solvent in the amount of 30.90 lb-moles/hr. (14.05 kg-moles/hr.) is recovered in line 32 and generally admixed with the lean solvent stream returned to extraction zone 1 through line 10. Fresh solvent, to compensate for that removed via line 33, may be added at any convenient point such as with the regenerated solvent return in line 32.

The foregoing illustrates the preferred technique where 100.0% of the lean solvent introduced into extraction zone 1 with the hydrocarbon feed in line 9 is obtained from the side-cut material in line 25. Significantly less stripping medium in the lower section of recovery column 5 is required in line 26. Considering the overall "energy duty" associated with the stripping medium introduced into the solvent recovery column, there is a savings of approximately $1.62 \times 10^6$ BTU/hr., or $0.41 \times 10^6$ kg-calories/hr. Where the 405.05 lb-moles/hr. of lean solvent is obtained 100.0% from line 10, via line 34, the savings approximate $1.43 \times 10^6$ BTU/hr., or 0.36 kg-calories/hr. Those skilled in the art will recognize how this can be advantageously translated to other sections of the process. Introducing the side-cut from the recovery column into the stripper column in admixture with the feed, affords an enhancement of the non-aromatic/aromatic separation in the upper regions of the stripper.

I claim as my invention:

1. A process for the recovery of aromatic hydrocarbons from a mixture thereof with non-aromatic hydrocarbons, which process comprises the steps of:

a. introducing said aromatic/non-aromatic mixture into an extraction zone, and therein contacting said mixture with a solvent having water dissolved therein characteristically selected for absorbing aromatic hydrocarbons, at conditions selected to maintain said mixture and solvent in liquid phase;

b. removing a non-aromatic hydrocarbon raffinate stream fron said zone, through an upper locus thereof;

c. removing an aromatic hydrocarbon, solvent-rich extract stream from said zone, through a lower locus thereof, and introducing said extract stream into a stripper column;

d. removing a non-aromatic hydrocarbon concentrate from said stripper column, through an upper locus thereof, and removing an aromatic hydrocarbon-containing first solvent-rich stream from said stripper column, through a lower locus thereof;

e. introducing said first solvent-rich stream into a solvent recovery column, through a first locus thereof, introducing a vaporous steam stripping medium into a lower, second locus thereof, recovering a substantially solvent-free aromatic hydrocarbon concentrate through an upper third locus thereof, removing a substantially hydrocarbon-free, second solvent-rich stream from a lower fourth locus thereof and removing a third solvent-rich stream, containing hydrocarbons, through an intermediate fifth locus thereof;

f. introducing at least a portion of said third solvent-rich stream into said stripper column; and, g. commingling a portion of only said third solvent-rich stream with said aromatic-non-aromatic mixture for introduction therewith into said extraction zone.

2. The method of claim 1 further characterized in that the portion of said third solvent-rich stream is introduced into said stripper column with said aromatic hydrocarbon, solvent-rich extract stream.

3. The method of claim 1 further characterized in that said non-aromatic hydrocarbons are naphthenic.

4. The method of claim 1 further characterized in that said solvent is a sulfolane-type organic compound.

5. The method of claim 1 further characterized in that said solvent is a polyalkylene glycol.

6. The process of claim 1 further characterized in that the portion of one of said second and third solvent-rich streams is about 5.0% to about 25.0% by volume of the total solvent introduced into said extraction zone.

7. The process of claim 1 further characterized in that the volumetric ratio of said second solvent-rich stream to said third solvent-rich stream is in the range of about 1.5:1.0 to about 4.0:1.0.

8. A process for the recovery of aromatic hydrocarbons from a mixture thereof with non-aromatic hydrocarbons, which process comprises the steps of:

a. introducing said aromatic/non-aromatic mixture into an extraction zone, and therein contacting said mixture with a solvent having water dissolved therein characteristically selected for adsorbing aromatic hydrocarbons, at conditions selected to maintain said mixture and solvent in liquid phase;

b. removing a non-aromatic hydrocarbon raffinate stream from said zone, through an upper locus thereof;

c. removing an aromatic hydrocarbon, solvent-rich extract stream from said zone, through a lower locus thereof, and introducing said extract stream into a stripper column;

d. removing a non-aromatic hydrocarbon concentrate from said stripper column, through an upper locus thereof, and removing an aromatic hydrocarbon-containing first solvent-rich stream from said stripper column, through a lower locus thereof;

e. introducing said first solvent-rich stream into a solvent recovery column, through a first locus thereof, introducing a vaporous stream stripping medium into a lower, second locus thereof, recovering a substantially solvent-free aromatic hydrocarbon concentrate through an upper third locus thereof, removing a substantially hydrocarbon-free, second solvent-rich stream from a lower fourth locus thereof and removing a third solvent-rich stream, containing hydrocarbons, through an intermediate fifth locus thereof;

f. introducing at least a portion of said third solvent-rich stream into said stripper column; and, g. commingling a portion of both said second and third solvent-rich streams with said aromatic/non-aromatic mixture for introduction therewith into said extraction zone.

* * * * *